US011506048B2

(12) United States Patent
Ringgenberg et al.

(10) Patent No.: US 11,506,048 B2
(45) Date of Patent: Nov. 22, 2022

(54) PERFORATING GUN ASSEMBLY FOR USE WITHIN A BOREHOLE

(71) Applicant: Halliburton Energy Services, Inc., Houston, TX (US)

(72) Inventors: Paul David Ringgenberg, Frisco, TX (US); Kenneth Lemoine Schwendemann, Flower Mound, TX (US); Adan H. Herrera, Baytown, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/154,500

(22) Filed: Jan. 21, 2021

(65) Prior Publication Data

US 2022/0228475 A1 Jul. 21, 2022

(51) Int. Cl.

| | |
|---|---|
| ***E21B 47/06*** | (2012.01) |
| ***E21B 17/02*** | (2006.01) |
| ***E21B 43/116*** | (2006.01) |

(52) U.S. Cl.

CPC ..... *E21B 47/06* (2013.01); *E21B 17/02* (2013.01); *E21B 43/116* (2013.01)

(58) Field of Classification Search

CPC ..... E21B 47/06; E21B 17/02; E21B 43/126
See application file for complete search history.

(56) References Cited

U.S. PATENT DOCUMENTS

| | | | | |
|---|---|---|---|---|
| 5,799,732 | A | 9/1998 | Gonzalez | |
| 8,074,713 | B2 | 12/2011 | Ramos | |
| 8,620,636 | B2 | 12/2013 | Zhan | |
| 8,991,492 | B2 | 3/2015 | Lovell | |
| 10,132,159 | B2 | 11/2018 | Burgos | |
| 2004/0104029 | A1 | 6/2004 | Martin | |
| 2005/0268709 | A1* | 12/2005 | McGregor | E21B 49/10 73/152.27 |
| 2007/0193740 | A1 | 8/2007 | Quint | |
| 2014/0338439 | A1 | 11/2014 | Ligneul | |
| 2017/0030186 | A1 | 2/2017 | Rodgers | |
| 2021/0062623 | A1* | 3/2021 | Camp | E21B 33/138 |
| 2022/0018249 | A1* | 1/2022 | Harrigan | E21B 49/10 |

FOREIGN PATENT DOCUMENTS

| | | | |
|---|---|---|---|
| EP | 0404669 | A1 | 12/1990 |
| EP | 0931907 | A2 | 7/1999 |
| WO | 2015193655 | A1 | 12/2015 |

OTHER PUBLICATIONS

Qiao Deng, Study of Downhole Shock Loads for Ultra-Deep WellPerforation and Optimization Measures, Jun. 2019.

International Search Report and Written Opinion dated Oct. 15, 2021 for corresponding PCT Application No. PCT/US2021/016058 filed on Feb. 1, 2021.

* cited by examiner

*Primary Examiner* — Yong-Suk (Philip) Ro
(74) *Attorney, Agent, or Firm* — K&L Gates LLP

(57) ABSTRACT

A perforating gun assembly for use within a borehole. The perforating gun assembly may include a first perforating charge section, a second perforating charge section, and a tandem coupling the first perforating charge section to the second perforating charge section. The tandem may include a first sensor package that may be operable to determine a flowrate of formation fluid flowing around the tandem and a second sensor package that may be operable to identify the formation fluid.

15 Claims, 3 Drawing Sheets

PERFORATING GUN ASSEMBLY FOR USE WITHIN A BOREHOLE

BACKGROUND

This section is intended to provide relevant background information to facilitate a better understanding of the various aspects of the described embodiments. Accordingly, it should be understood that these statements are to be read in this light and not as admissions of prior art.

Boreholes are typically drilled using a drill string with a drill bit secured to downhole end and, in the situation of cased-hole wells, completed by positioning a casing string within the borehole and cementing the casing string in position. The casing increases the integrity of the borehole and prevents unwanted inflow of fluid from the formation into the borehole. However, the casing must be perforated to provide a flow path between the surface and selected subterranean formation for the injection of treating chemicals into the surrounding formation to stimulate production. Perforating the casing is also necessary for receiving the flow of hydrocarbons from the formation and for permitting the introduction of fluids for reservoir management or disposal purposes.

Perforating has conventionally been performed by lowering a perforating gun on a carrier inside the casing string to a desired depth and securing the perforating gun in place. The gun may have one or many charges that are detonated using a firing control, which may be activated from the surface. Once activated, the charge is detonated to perforate the casing and the cement outside the casing. This establishes the desired flow paths through the casing and into the formation for communication with the surface.

After the casing is perforated, a production logging tool is typically run downhole to determine which areas of the formation are producing the most fluid and what types of fluids are being produced from the formation. However, this requires a significant amount of time since the perforating gun must be withdrawn from the borehole and the production logging tool must be run down the borehole.

BRIEF DESCRIPTION OF THE DRAWINGS

Embodiments of perforating gun assembly are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes a perforating gun assembly for use in a borehole. The perforating gun assembly includes sensors that determine the flowrate of and identify fluid flowing across the perforating gun. This functionality allows the perforating gun to determine which areas of the formation are producing the most fluid and what types of fluids are being produced from the formation.

A borehole may in some instances be formed in a vertical orientation relative to the earth's surface, and a lateral borehole may in some instances be formed in a substantially horizontal orientation relative to the earth's surface. However, the orientation of each of these boreholes may include portions that are vertical, non-vertical, horizontal, or non-horizontal. Further, the term "uphole" refers a direction that is towards the earth's surface, while the term "downhole" refers a direction that is further into the earth's surface.

Figure 1:
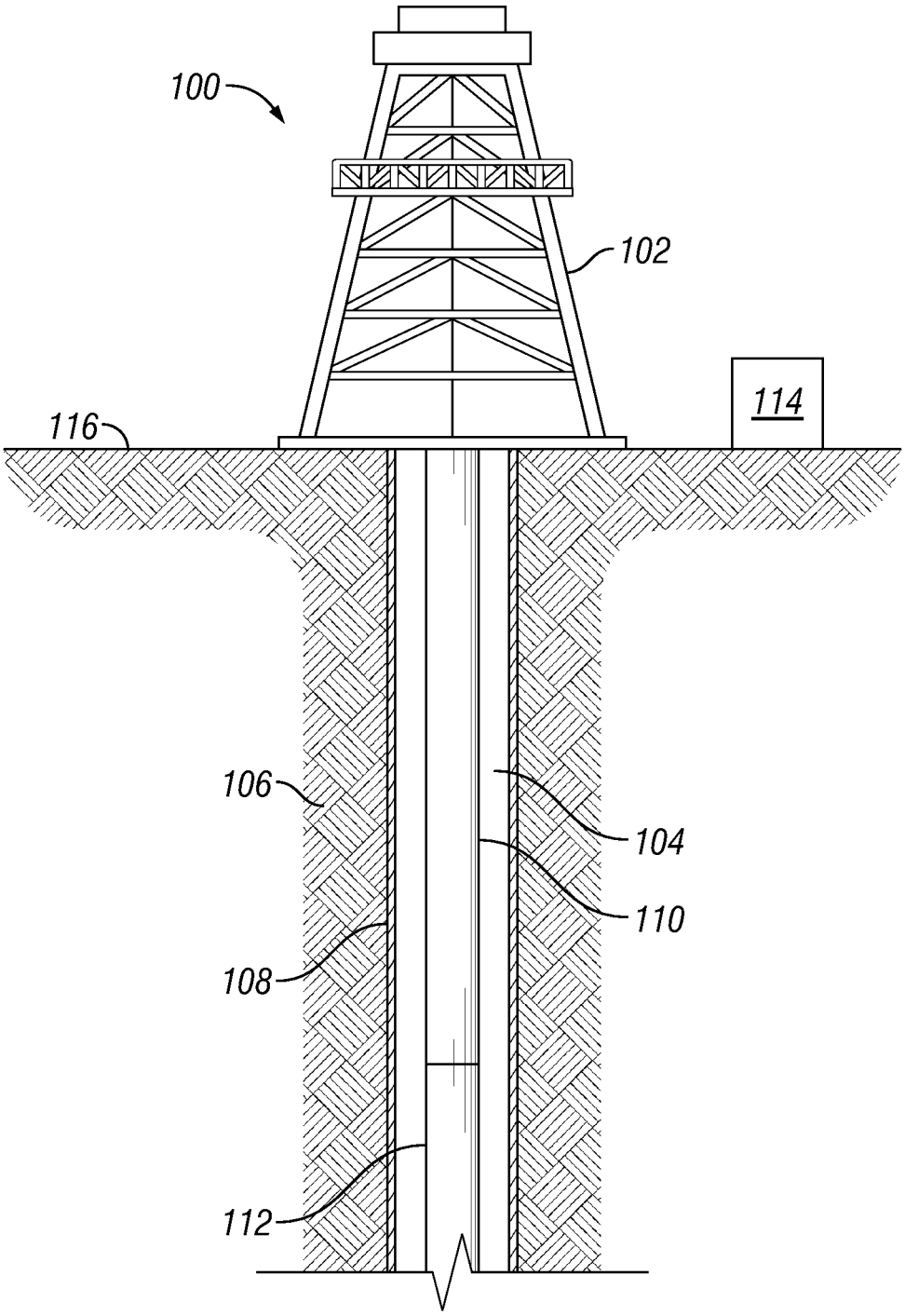
FIG. 1 is a schematic view of a well system, according to one or more embodiments.

FIG. 1 is a borehole system 100 that includes a rig 102 that is positioned over a borehole 104 that extends into a formation 106. The borehole 104 is an opening in the formation 106, and the borehole 104 may include a casing 108 or a lining or the borehole 104 may be an open hole. The borehole 104 may be utilized to extract fluids or store fluids, such as hydrocarbons or water. Further, while the borehole 104 is shown as extending vertically into the formation 106, the borehole 104, or portions of the borehole 104, may extend horizontally or at any angle between vertical and horizontal.

The rig 102 is utilized to aid in operations that include the use of the borehole 104. For example, the rig 102 may include a drilling rig, a completion rig, a workover rig, or a servicing rig. The rig 102 supports the tubing string 110, which conveys a perforating gun assembly 112 into the borehole 104. In some embodiments, the rig 102 may support a slickline unit, a wireline, a hoisting apparatus, a servicing vehicle, or a coiled tubing unit. Further, the borehole system 100 may be positioned at an offshore location. For example, the rig 102 may be supported by piers extending into the seabed or by a floating structure.

The perforating gun assembly includes a firing system (not shown) that activates one or more perforating charges (not shown) located on the perforating gun assembly 112 upon receiving a signal a control unit 114 located on the surface 116. The signal from the control unit 114 may be transmitted wirelessly to the perforating gun assembly, such as through telemetry, or through a wired connection with the perforating gun assembly 112. Once activated, the perforating charges perforate the casing 110 to enable production of formation fluids through the borehole 104.

Once the casing is perforated, sensor and electronics packages on the perforating gun assembly 112 measure the flowrate of and identify the formation fluid flowing uphole through the casing, as described in more detail below. This allows the operator to determine what is being produced from the formation and in what volume without additional steps, such as pulling the perforating gun assembly 112 and running a logging tool (not shown) downhole.

Figure 2:
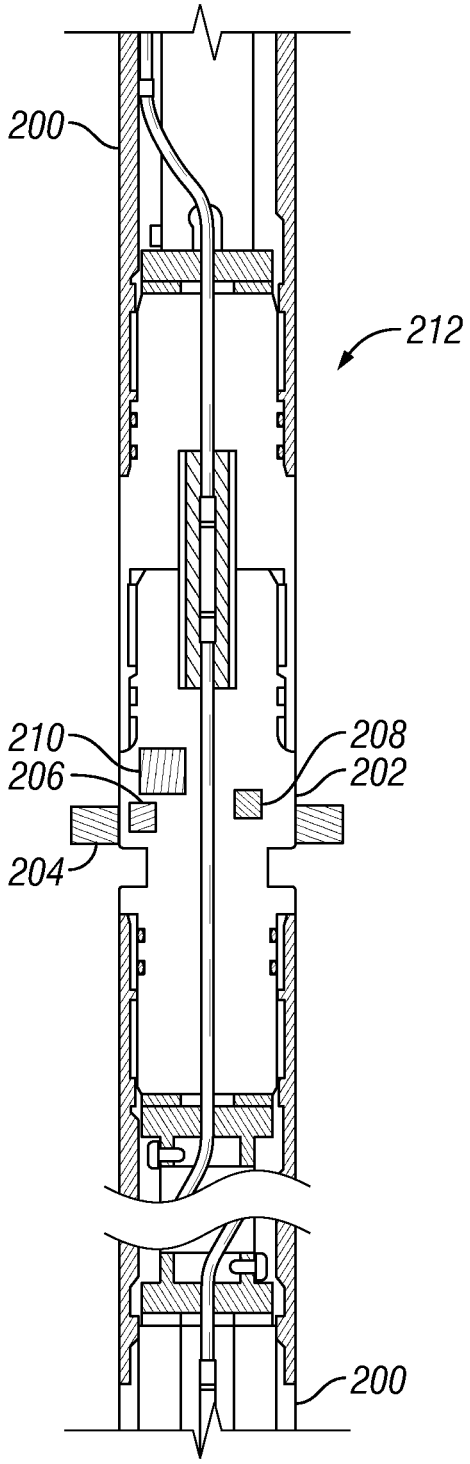
FIG. 2 is a partial, cross-sectional view of an embodiment of a perforating gun assembly, according to one or more embodiments.

Turning now to FIG. 2, FIG. 2 is a partial, cross-sectional view of an embodiment of a perforating gun assembly 212, according to one or more embodiments. The perforating gun assembly 212 includes two perforating sections 200, that each include perforating charges, coupled via a tandem 202. Although FIG. 2 illustrates two perforating sections and one tandem, the perforating gun assembly is not thereby limited. The perforating gun assembly may include three, four, or more perforating sections (not shown) with a tandem positioned between each of the sections.

As shown in FIG. 2, a portion 204 of the body of the tandem 202 has a larger diameter than the remainder of the tandem 202. The portion 204 may also have a larger outer diameter than the perforating sections 200 and act as a centralizer to position the perforating gun assembly 212 within the center of the borehole. The tandem 202 also includes a first sensor package 206, a second sensor package 208, and an electronics package 210. Each of the packages 206, 208, 210 may be powered via a wired connection to the surface, batteries, or other means of powering electronics downhole that are known to those skilled in the art.

The first sensor package 206 includes a differential pressure sensor that measures the differential pressure, i.e., the pressure drop, of formation fluid flowing across the portion 204 of the tandem 202. Alternatively, two sensors that take pressure measurements on either side of the portion 204 of the tandem 202 may be utilized to measure the differential pressure. The first sensor package 206 then determines the flowrate based on the measured pressure drop across the portion 204 and transmits the flowrate to the electronics package 210. In another embodiment, the first sensor package 206 may transmit the pressure measurements to the electronics package 210, which then determines the flowrate of the formation fluid.

The second sensor package 208 includes a sensor, such as, but not limited to, a capacitance sensor, a resistivity sensor, a compressibility sensor, an optical transparency sensor, a density sensor, or a viscosity sensor, that measures a characteristic, such as, but not limited to, capacitance, resistivity, compressibility, optical transparency, density, or viscosity, of the formation fluid flowing past the tandem 202. Based on the readings from the sensor, the second sensor package 208 determines the identity of the formation fluid, e.g., water, gaseous hydrocarbons, liquid hydrocarbons, or any combination thereof, and transmits the identity to the electronics package 210. In another embodiment, the second sensor package 208 may transmit the sensor readings to the electronics package 210, which then determines the identity of the formation fluid.

In addition to or in place of the above sensors, the second sensor package 208 may include an inflow control device that varies the flowrate of the fluid passing therethrough based on the make-up of the fluid, and a flowmeter. The formation fluid is flowed through the inflow control device and the flowrate of the fluid exiting the inflow control device is measured. Based on the flowrate of the fluid leaving the inflow control device, the second sensor package 208 and/or the electronics package 210 can determine the identity of the formation fluid.

As discussed above, the electronics package 210 receives information, such as pressure measurements, fluid characteristic measurements, formation fluid flowrate, and the identity of the formation fluid, from the first sensor package 206 and the second sensor package 208. The electronics package may store this information locally and/or transmit the information uphole to another tandem, a borehole telemetry system, or directly to a control unit located on the surface via acoustic telemetry or other wireless communication means known to those skilled in the art or through a wired connection. In other embodiments, the first sensor package 206, the second sensor package 208, and the electronics package 210 may be combined into a single package or the functions of the electronics package 210 may be integrated into the first sensor package 206 and the second sensor package 208 and there may not be a distinct electronics package 210.

Figure 3:
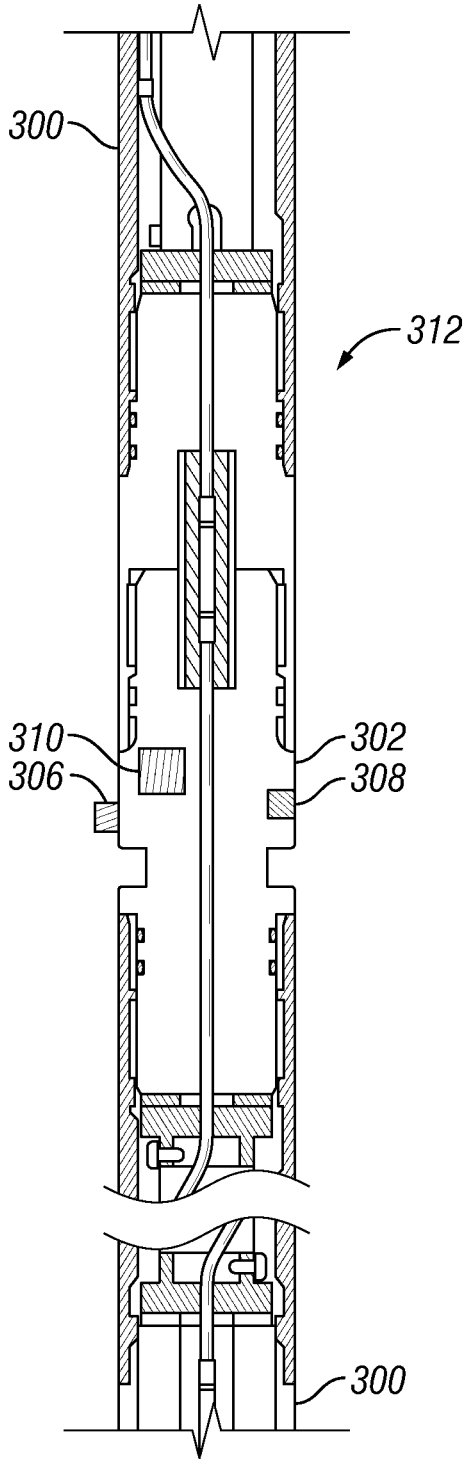
FIG. 3 is a partial, cross-sectional view of another embodiment of a perforating gun assembly.

Turning now to FIG. 3, FIG. 3 is a partial, cross-sectional view of a perforating gun assembly 312, according to a second embodiment. FIG. 3 includes features that are similar to those described in relation to FIG. 2. Accordingly, similar elements will not be described again in detail, except as necessary to describe the features of the perforating gun assembly 302.

As shown in FIG. 3, the perforating gun assembly 312 includes two perforating sections 300, that each include perforating charges, coupled via a tandem 302. Similar to the perforating gun assembly 212, the tandem 302 includes a first sensor package 306, a second sensor package 308, and an electronics package 310. However, unlike the perforating gun assembly 212, the tandem does not include a portion having a larger diameter and the first sensor package 306 does not include a differential pressure sensor. Instead, the first sensor package 306 includes a flowmeter positioned on an exterior of the tandem 302. The flowmeter directly measures the flow of formation fluid past the tandem, instead of the flowrate being calculated based on a pressure drop. The first and second sensor packages 306, 308 otherwise operate in a similar manner as the perforating gun assembly 212 to determine the flowrate and identification of fluid past the tandem 302.

Further examples include:

Example 1 is a perforating gun assembly for use within a borehole. The perforating gun assembly includes a first perforating charge section, a second perforating charge section, and a tandem coupling the first perforating charge section to the second perforating charge section. The tandem includes a first sensor package that is operable to determine a flowrate of formation fluid flowing around the tandem and a second sensor package that is operable to identify the formation fluid.

In Example 2, the embodiments of any preceding paragraph or combination thereof further include wherein the tandem comprises a body, a portion of which has an outer diameter that is larger than the first perforating charge section and the second perforating charge section.

In Example 3, the embodiments of any preceding paragraph or combination thereof further include wherein the first sensor package comprises a differential pressure sensor that is operable to measure the differential pressure across the portion of the body and determine the flowrate of the formation fluid based on the differential pressure.

In Example 4, the embodiments of any preceding paragraph or combination thereof further include wherein the first sensor package comprises a first sensor operable to measure a pressure of the formation fluid before flowing across the portion of the body and a second sensor operable to measure a pressure of the formation fluid after flowing across the portion of the body, and the first sensor package is operable to determine the flowrate of the formation fluid based on the measured pressures.

In Example 5, the embodiments of any preceding paragraph or combination thereof further include wherein the tandem further comprises an electronics package operable to transmit at least one of the identity of the formation fluid or the flowrate of the formation fluid.

In Example 6, the embodiments of any preceding paragraph or combination thereof further include wherein the tandem further comprises an electronics package operable to store at least one of the identity of the formation fluid or the flowrate of the formation fluid.

In Example 7, the embodiments of any preceding paragraph or combination thereof further include wherein the first sensor package comprises a flowmeter that is operable to measure the flowrate of the formation fluid.

In Example 8, the embodiments of any preceding paragraph or combination thereof further include wherein the second sensor package comprises at least one of a capacitance sensor, a resistivity sensor, a compressibility sensor, an optical transparency sensor, a density sensor, or a viscosity sensor.

Example 9 is a method of determining properties of formation fluid produced from a formation. The method includes perforating a casing installed within a borehole that extends through the formation with a perforating gun assembly. The method also includes flowing the formation fluid across the perforating gun assembly. The method further includes determining a flowrate of the formation fluid flowing across a tandem of the perforating gun assembly using a first sensor package of the tandem. The method also includes identifying the formation fluid flowing across tandem using a second sensor package of the tandem.

In Example 10, the embodiments of any preceding paragraph or combination thereof further include wherein determining the flowrate of the formation fluid flowing across the tandem comprises determining the flowrate based on a differential pressure across a portion of a body of the tandem that has an outer diameter that is larger than a remainder of the perforating gun assembly.

In Example 11, the embodiments of any preceding paragraph or combination thereof further include storing at least one of the flowrate of the formation fluid or the identity of the formation fluid.

In Example 12, the embodiments of any preceding paragraph or combination thereof further include transmitting at least one of the flowrate of the formation fluid or the identity of the formation fluid.

Example 13 is a tandem for coupling two perforating charge sections of a perforating gun assembly for use within a cased borehole. The tandem includes a first sensor package that is operable to determine a flowrate of formation fluid flowing around the tandem and a second sensor package that is operable to identify the formation fluid.

In Example 14, the embodiments of any preceding paragraph or combination thereof further include wherein a portion of a body of the tandem has an outer diameter that is larger than a remainder of the body of the tandem.

In Example 15, the embodiments of any preceding paragraph or combination thereof further include wherein the first sensor package comprises a differential pressure sensor that is operable to measure the differential pressure across the portion of the body and the first sensor package is operable to determine the flowrate of the formation fluid based on the differential pressure.

In Example 16, the embodiments of any preceding paragraph or combination thereof further include wherein the first sensor package comprises a first sensor operable to measure a pressure of the formation fluid before flowing across the portion of the body and a second sensor operable to measure a pressure of the formation fluid after flowing across the portion of the body, and the second sensor package is operable to determine the flowrate of the formation fluid based on the measured pressures.

In Example 17, the embodiments of any preceding paragraph or combination thereof further include an electronics package operable to transmit at least one of the identity of the formation fluid or the flowrate of the formation fluid.

In Example 18, the embodiments of any preceding paragraph or combination thereof further include an electronics package operable to store at least one of the identity of the formation fluid or the flowrate of the formation fluid.

In Example 19, the embodiments of any preceding paragraph or combination thereof further include wherein the first sensor package comprises a flowmeter that is operable to measure the flowrate of the formation fluid.

In Example 20, the embodiments of any preceding paragraph or combination thereof further include wherein the second sensor package comprises at least one of a capacitance sensor, a resistivity sensor, a compressibility sensor, an optical transparency sensor, a density sensor, or a viscosity sensor.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A perforating gun assembly for use within a borehole, the perforating gun assembly comprising:

a first perforating charge section;

a second perforating charge section; and a tandem coupling the first perforating charge section to the second perforating charge section, the tandem comprising:

a first sensor package operable to determine a flowrate of formation fluid flowing around the tandem; and a second sensor package operable to identify the formation fluid, wherein the tandem comprises a body, a portion of which has an outer diameter that is larger than the first perforating charge section and the second perforating charge section, wherein the first sensor package comprises a differential pressure sensor that is operable to measure the differential pressure across the portion of the body and the first sensor package is operable to determine the flowrate of the formation fluid based on the differential pressure.

2. The perforating gun of claim 1, wherein the first sensor package comprises a first sensor operable to measure a pressure of the formation fluid before flowing across the portion of the body and a second sensor operable to measure a pressure of the formation fluid after flowing across the portion of the body, and the first sensor package is operable to determine the flowrate of the formation fluid based on the measured pressures.

3. The perforating gun of claim 1, wherein the tandem further comprises an electronics package operable to transmit at least one of the identity of the formation fluid or the flowrate of the formation fluid.

4. The perforating gun of claim 1, wherein the tandem further comprises an electronics package operable to store at least one of the identity of the formation fluid or the flowrate of the formation fluid.

5. The perforating gun of claim 1, wherein the first sensor package comprises a flowmeter that is operable to measure the flowrate of the formation fluid.

6. The perforating gun of claim 1, wherein the second sensor package comprises at least one of a capacitance sensor, a resistivity sensor, a compressibility sensor, an optical transparency sensor, a density sensor, or a viscosity sensor.

7. A method of determining properties of formation fluid produced from a formation, the method comprising:

perforating a casing installed within a borehole that extends through the formation with a perforating gun assembly;

flowing the formation fluid across the perforating gun assembly;

determining a flowrate of the formation fluid flowing across a tandem of the perforating gun assembly using a first sensor package of the tandem; and identifying the formation fluid flowing across tandem using a second sensor package of the tandem, wherein determining the flowrate of the formation fluid flowing across the tandem comprises determining the flowrate based on a differential pressure across a portion of a body of the tandem that has an outer diameter that is larger than a remainder of the perforating gun assembly.

8. The method of claim 7, further comprising storing at least one of the flowrate of the formation fluid or the identity of the formation fluid.

9. The method of claim 7, further comprising transmitting at least one of the flowrate of the formation fluid or the identity of the formation fluid.

10. A tandem for coupling two perforating charge sections of a perforating gun assembly for use within a cased borehole, the tandem comprising:

a first sensor package operable to determine a flowrate of formation fluid flowing around the tandem within the borehole; and a second sensor package operable to identify the formation fluid, wherein a portion of a body of the tandem has an outer diameter that is larger than a remainder of the body of the tandem, wherein the first sensor package comprises a differential pressure sensor that is operable to measure the differential pressure across the portion of the body and the first sensor package is operable to determine the flowrate of the formation fluid based on teh differential pressure.

11. The tandem of claim 10, wherein the first sensor package comprises a first sensor operable to measure a pressure of the formation fluid before flowing across the portion of the body and a second sensor operable to measure a pressure of the formation fluid after flowing across the portion of the body, and the second sensor package is operable to determine the flowrate of the formation fluid based on the measured pressures.

12. The tandem of claim 10, further comprising an electronics package operable to transmit at least one of the identity of the formation fluid or the flowrate of the formation fluid.

13. The tandem of claim 10, further comprising an electronics package operable to store at least one of the identity of the formation fluid or the flowrate of the formation fluid.

14. The tandem of claim 10, wherein the first sensor package comprises a flowmeter that is operable to measure the flowrate of the formation fluid.

15. The tandem of claim 10, wherein the second sensor package comprises at least one of a capacitance sensor, a resistivity sensor, a compressibility sensor, an optical transparency sensor, a density sensor, or a viscosity sensor.

* * * * *